US005087945A

United States Patent [19]

Randall

[11] Patent Number: 5,087,945

[45] Date of Patent: Feb. 11, 1992

[54] METHOD AND APPARATUS FOR FORMING MULTICOLOR TONER IMAGES

[75] Inventor: Kent A. Randall, Webster, N.Y.

[73] Assignee: Eastman Kodak Company, Rochester, N.Y.

[21] Appl. No.: 590,872

[22] Filed: Oct. 1, 1990

[51] Int. Cl.[5] ..... G03G 15/14; G03G 15/01

[52] U.S. Cl. ..... 355/272; 355/327

[58] Field of Search ..... 355/326, 327, 272; 346/157

[56] References Cited

U.S. PATENT DOCUMENTS

| | | | |
|---|---|---|---|
| 4,162,843 | 7/1979 | Inoue et al. | 355/327 |
| 4,232,961 | 11/1980 | Masuda | 355/271 |
| 4,428,662 | 1/1984 | Day | 355/327 |
| 4,580,889 | 4/1986 | Hiranuma et al. | 355/327 |
| 4,967,236 | 10/1990 | Rodenberg et al. | 355/272 |
| 4,987,455 | 1/1991 | Lubberts | 355/326 X |

FOREIGN PATENT DOCUMENTS

| | | | |
|---|---|---|---|
| 0115476 | 5/1987 | Japan | 355/326 |
| 0115479 | 5/1987 | Japan | 355/326 |
| 0041867 | 2/1988 | Japan | 355/326 |
| 63-96675 | 4/1988 | Japan . | |
| 0012273 | 1/1990 | Japan | 355/327 |
| 0105175 | 4/1990 | Japan | 355/327 |

*Primary Examiner*—A. T. Grimley
*Assistant Examiner*—Nestor R. Ramirez
*Attorney, Agent, or Firm*—Leonard W. Treash, Jr.

[57] ABSTRACT

Multicolor toner images are formed by first forming separate color images by four separate image-forming devices. Two of those images are transferred in registration to a first intermediate drum to form a two-color image which two-color image is then transferred to a second intermediate drum. The third and fourth color toner images are transferred in registration to the second intermediate drum to form a four-color toner image. The transfer of the two-color image to the second intermediate drum can be accomplished before or after transfer of the third and fourth images. The four-color toner image can be transferred to a receiving sheet in one step.

10 Claims, 3 Drawing Sheets

METHOD AND APPARATUS FOR FORMING MULTICOLOR TONER IMAGES

TECHNICAL FIELD

This invention relates to the formation of multicolor toner images by the use of separate distinct imaging members for formation of single color toner images that are subsequently combined to form the multicolor image.

BACKGROUND ART

U.S. Pat. No. 4,232,961 shows multicolor imaging apparatus in which three or four imaging members are separately charged, exposed and toned to create toner images in different colors and those toner images are transferred in registration to an intermediate web from which they are transferred to a receiving sheet. Apparatus with separate imaging members for creation of separate color toner images is many times faster than present commercial devices in which the images are formed consecutively on a web or drum photoconductor.

A number of other references show separate imaging members which create separate color toner images and transfer them directly to a receiving sheet. See, for example, U.S. Pat. No. 4,464,501 and U.S. Pat. No. 4,162,843. In U.S. Pat. No. 4,580,889 the transfer sheets are presented to the imaging members by attaching them to the surface of a drum rather than a moving web which is shown in the rest of the above references.

Maintenance of cross track and skew registration in combining separate toner images from different sources is an extremely challenging task. In devices in which the images are transferred to a web (U.S. Pat. No. 4,232,961) or transferred to a receiving sheet carried by a web (U.S. Pat. No. 4,464,501 and U.S. Pat. No. 4,162,843) any variation in web tracking between transfers will cause misregistration.

The approach shown in U.S. Pat. No. 4,580,889 (see also Japanese Kokai 63/96675 published Apr. 27, 1988) in which the members carrying the toner images are positioned around a drum and the receiving sheet is tacked to the drum essentially solves this cross track registration problem. That is, the receiving sheet, once tacked to the drum, will follow the drum through all four transfers. The drum itself can be controlled to avoid cross track registration problems.

In order to provide the space on the periphery of the drum for four separate imaging members, as well as the toner supply for each member, the drum itself must be of substantial diameter. This is especially true if the developing mechanism for creating the toner images works best in limited orientations, for example, if it prefers to tone an image generally above the toning station.

STATEMENT OF THE INVENTION

It is an object of the invention to provide a method and apparatus of creating a multicolor toner image, for example, a four-color image, using separate imaging members, but with good cross track and skew registration in a compact machine geometry.

This and other objects are accomplished by utilizing first and second intermediate drums. Two color toner images are transferred from separate toner image-forming devices in registration to the first drum to form a two color image and the other two single color toner images are transferred in registration to the other drum.

The two color image on the first drum is transferred to the second drum where all four images are combined, creating a four color image on the second drum which can then be transferred in one step to a receiving sheet.

According to preferred embodiments, the two color image can be transferred to the second drum either before or after the other two single color images are transferred to the second drum.

With this structure, the two drums can readily be kept aligned to maintain cross track and skew registration. However, they take up much less space than a single drum would in accomplishing the same objective.

This approach can be used in systems in which the toner image-forming devices are separate electrophotographic devices, each with its own photoconductor and exposure mechanism. It may also be used with systems in which the individual imaging members are essentially xeroprinting devices.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
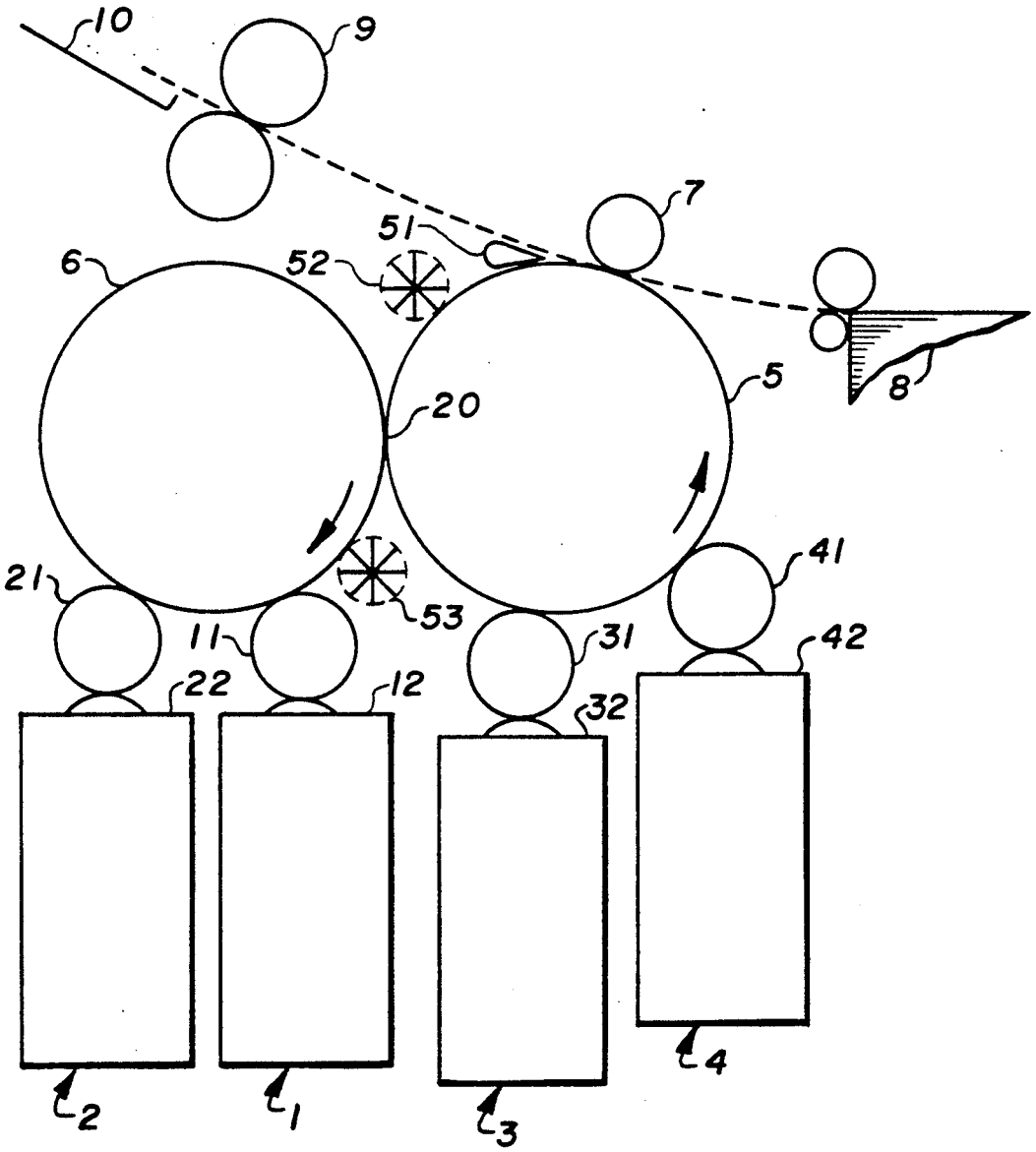
FIG. 1 is a side schematic of an embodiment of an apparatus for practicing the invention.

According to FIG. 1, a multicolor toner image-forming apparatus includes four separate toner image-forming devices 1, 2, 3 and 4. Each of said image-forming devices includes an imaging member 11, 21, 31 and 41 and a toning component 12, 22, 32, and 42, respectively.

Figure 2:
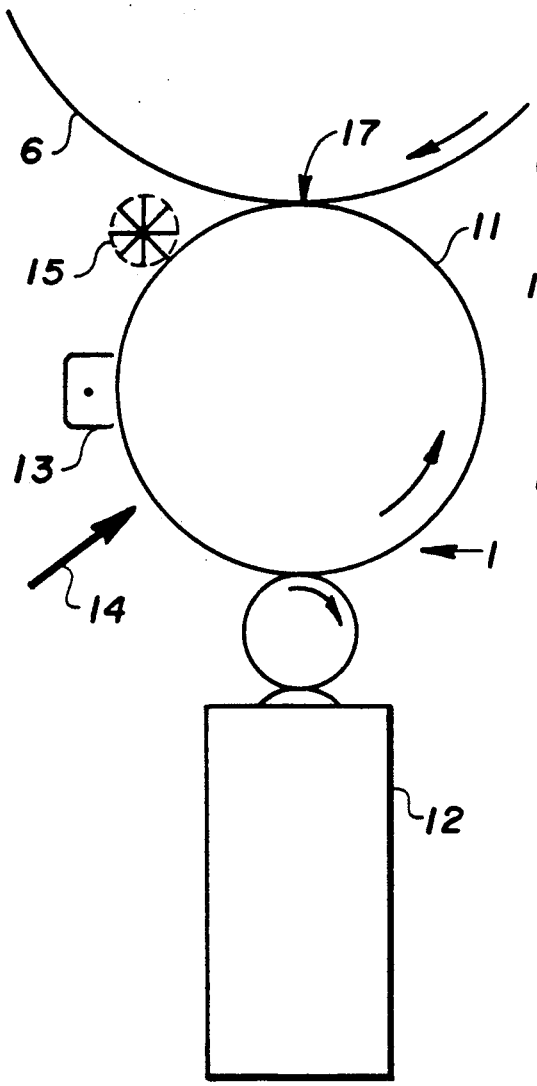
FIGS. 2 and 3 are side schematics of two alternative embodiments for one of the imaging members shown in FIG. 1 or FIG. 4.
Figure 3:
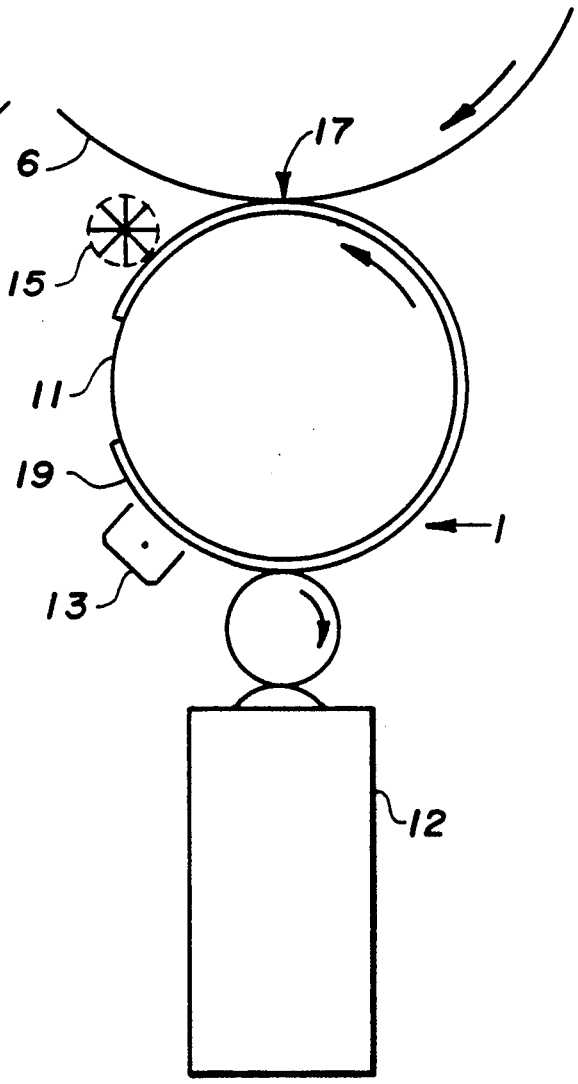

As known in the art, and described more completely with respect to FIGS. 2 and 3, toner images of different color are formed on the surface of members 11, 21, 31 and 41. These toner images are to be combined into a multicolor image on a transfer sheet fed from a supply 8. To accomplish this, a first toner image of a first color formed on image member 11 is transferred to a first intermediate transfer drum 6.

A second toner image of a second color formed by second device 2 is transferred from second imaging member 21 to first intermediate transfer drum 6 in registration with the first toner image transferred from member 11. This creates a two-color image on intermediate transfer drum 6. The two-color image on first intermediate transfer drum 6 is transferred to a second intermediate transfer drum 5 at transfer station 20. As the two-color image on drum 5 passes devices 3 and 4, third and fourth toner images of still different colors are transferred to second intermediate transfer drum 5 in registration with the two-color image from first drum 6 to create a four-color toner image on second intermediate transfer drum 5. The four-color image is transferred from drum 5 to a receiving sheet fed from receiving sheet supply 8 between drum 5 and a transfer backing roller 7. The receiving sheet is picked off drum 5 by a pick off 51 and moved to a fuser 9 where the image is fixed to the receiving sheet and ultimately deposited in an output tray 10. The intermediate transfer drums 5 and 6 are cleaned by cleaning stations 52 and 53 which are positioned to allow the apparatus to operate continuously without articulation of the cleaning stations or an interruption in image formation.

Imaging members 11, 21, 31 and 41 and intermediate transfer members 5 and 6 being drums can be mounted with extremely tight tolerances resulting in very tight control of cross track and skew image location. This provides accurate cross track and skew registration of the colors that is superior to any cross track and skew registration available with intermediate webs or receiving sheets carried by webs. In fact, the registration is comparable to that provided by replacing drums 5 and 6 with a single large drum to which the images are transferred or which carries a receiving sheet to which they are transferred. However, if a single large drum were substituted for drums 5 and 6 in the FIG. 1 apparatus, it would have to have a diameter approximating twice the diameter of each of the drums 5 and 6. Such a drum would extend to twice the height of the combination of drums 5 and 6 as seen in FIG. 1.

The problem of providing compactness in this type of structure is exacerbated by the size of the toning modules 12, 22, 32 and 42, compared to the rest of the apparatus. If the apparatus is to be run for substantial numbers of copies without adding toner, the toner modules must be of substantial size. This makes it difficult to position them at different angles around a single drum without making that drum quite large. Further, many toning systems operate best in a particular orientation, for example, as shown in FIG. 1, applying toner to an electrostatic image directly above the toning module.

Referring to FIG. 2, some of the detail of one of the toner image formation devices 1 is shown. The other toner image formation devices 2, 3 and 4 are substantially identical. According to FIG. 2, toner image formation device 1 includes a photoconductive drum 11 which is uniformly charged by a charging station 13 and imagewise exposed by an exposure station, for example, a laser 14 to create an electrostatic image which electrostatic image is toned by toning station 12 to create a toner image. The toner image is then transferred at a transfer station 17 to first intermediate image drum 6. The photoconductive drum 11 can be made quite small since it does not have to be a full frame in size, but only big enough to position the appropriate stations around its periphery. The charging station 13 and laser 14 do not take up substantial space. However, the toning station 12 requires space for enough toner that the operator does not need to replace toner continually. As shown in FIG. 1, it is convenient to have fairly elongated toning stations positioned below the imaging members and absorbing virtually all the space directly below intermediate transfer drums 5 and 6.

According to FIG. 3, the toner images can also be formed by xeroprinting. According to FIG. 3, a xeroprinting master 19 has a conductive image on an insulating background, or vice-versa, which is charged by charging station 13 to create an electrostatic image defined by the conductive image. That image is then toned by toning station 12 and is transferred to drum 6 as with the embodiment shown in FIG. 2.

In both embodiments shown in FIG. 2 and FIG. 3, a cleaning station 15 is shown to clean either photoconductive drum 11 or xeroprinting master 19 between images.

Because the images formed by image forming devices 1 and 2 will have one more transfer than the images formed by devices 3 and 4, the images formed by those members must be optically reversed from the images formed by devices 3 and 4. Since exposure by laser or similar electronic exposure device is preferred for this invention, such reversal is done by appropriate programming which is well-known in the art.

The invention is shown with a series of image members 1, 2, 3 and 4 generally aligned along the bottom of the apparatus with the imaging members 11, 21, 31 and 41 positioned at the tops of the devices. However, other arrangements can also utilize the invention. For example, the drums 11, 21, 31 and 41 can be positioned toward the top of drums 5 and 6 with the toning stations toning at the sides of each drum and the toning supplies extending upward. In this arrangement, other aspects would also be reversed from that shown in FIG. 1. For example, the receiving sheet would be fed across the bottom of the apparatus.

Figure 4:
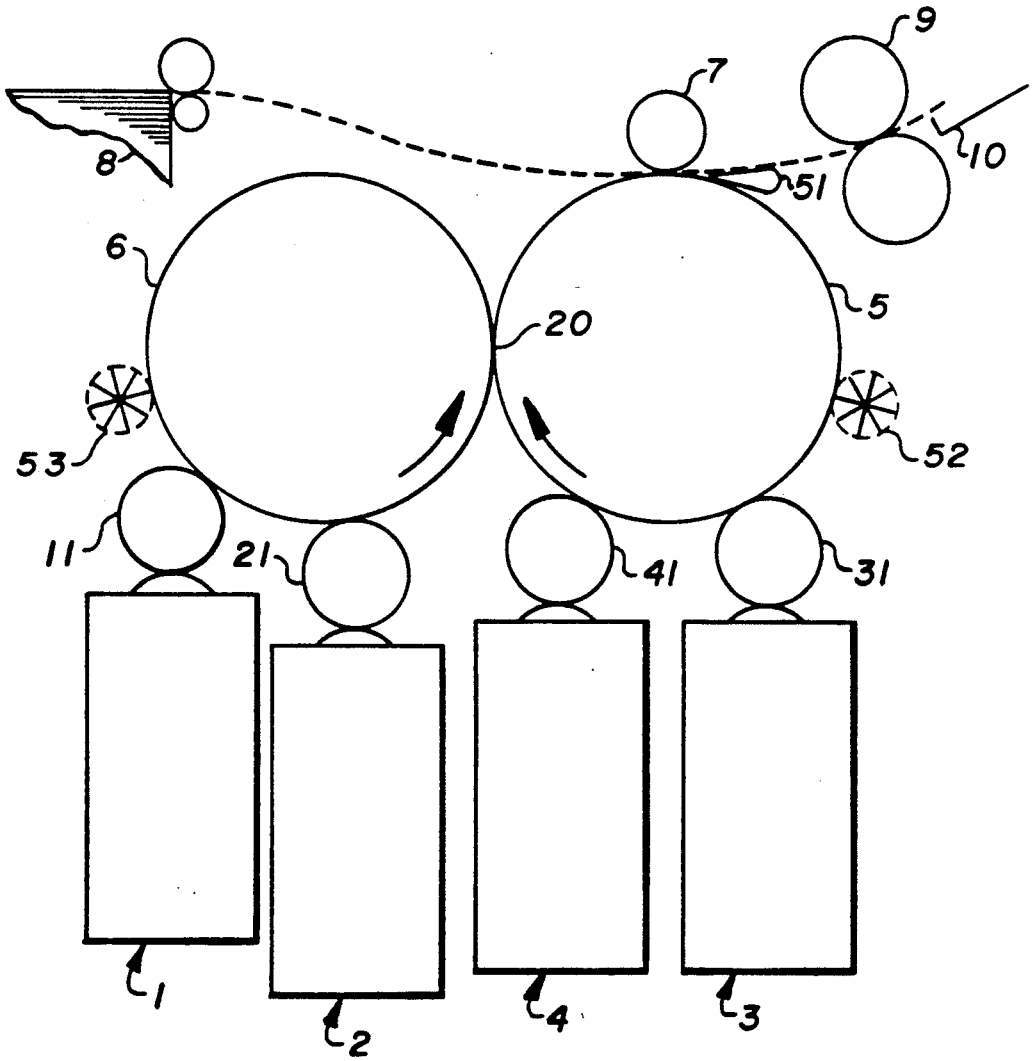
FIG. 4 is a side schematic of another embodiment of an apparatus for practicing the invention.

In the FIG. 1 embodiment the two color image on drum 6 is transferred to drum 5 before the single color images from drums 31 and 41 are transferred to drum 5. This is not the only usable approach. According to FIG. 4, the drums are rotated in directions opposite that of FIG. 1 and the images from devices 3 and 4 are transferred to drum 5 in registration before transfer of the two color image from drum 6 to drum 5 (or vice versa). Thus, two two-color images are combined at transfer station 20 in the FIG. 4 embodiment. Choice between the embodiments depends at least in part upon the desired location for the receiving sheet supply, fuser and output tray.

The invention has been described in detail with particular reference to a preferred embodiment thereof, but it will be understood that variations and modifications can be effected within the spirit and scope of the invention as described hereinabove and as defined in the appended claims.

I claim:

1. Apparatus for forming multicolor toner images, said apparatus comprising:

at least first, second, third and fourth toner image forming devices each such device having an image surface and including means for creating transferable toner images on said surfaces of different colors, first and second intermediate drums, means for transferring toner images from the image surfaces of said first and second image-forming devices to said first intermediate drum in registration to form a two-color toner image, means for transferring said two-color toner image from said first intermediate drum to said second intermediate drum, means for transferring toner images from the image surfaces of said third and fourth toner image forming devices to said second intermediate transfer drum in registration, said transfers being in an order and in sufficient registration to form a four-color multicolor image on said second intermediate drum.

2. Apparatus according to claim 1 further including means for transferring said four-color, multicolor image from the second intermediate drum to a receiving sheet.

3. The apparatus according to claim 1 wherein said first and second toner image-forming devices include means for forming toner images which are in reverse optical orientation with respect to the toner images formed by said third and fourth toner image forming devices.

4. The apparatus according to claim 1 wherein said toner image forming devices are generally aligned below said first and second intermediate transfer members.

5. The apparatus according to claim 4 wherein each of said toner image forming devices includes means for creating an electrostatic image on said image forming surface and means for toning said electrostatic image, and wherein respective toning means for the four image forming devices are generally positioned parallel to each other below their respective image forming surfaces.

6. Apparatus according to claim 1 wherein each of said image forming devices includes a photoconductive drum, means for uniformly charging said photoconductive drum, means for imagewise exposing said charged photoconductive drum to create an electrostatic image and means for toning said electrostatic image to create said toner image.

7. Apparatus according to claim 1 wherein each of said image forming devices includes a drum for holding a xeroprinting master that has a pattern of conductive and insulating areas, means for charging said xeroprinting master to form an electrostatic image defined by said conductive and insulating areas, and means for toning said electrostatic images.

8. Apparatus according to claim 1 wherein said transfer of said two color image occurs before transfer of toner images from said third and fourth color devices, and said transfers from said third and fourth devices is done in registration with said two color image to form a four color image.

9. Apparatus according to claim 1 wherein said transfer of said two color image occurs after transfer of toner images from said third and fourth color devices, and said transfer from said third and fourth color devices forms another two color image and said transfer of said two color image to said second drum is done in registration with said another two color image to form a four color image.

10. A method of forming multicolor toner images, said method comprising:

forming different color toner images on at least four distinct image members, transferring first and second color images to a first intermediate member in registration to create a two-color toner image, transferring said two-color toner image to a second intermediate member and transferring third and fourth images from their image members directly to said second intermediate transfer member, said transfers to said second intermediate transfer member being coordinated to combine said images into a four-color toner image on said second intermediate member, and transferring said four-color toner image to a receiving sheet.

* * * * *